US009548578B2

(12) United States Patent
Azoulay

(10) Patent No.: US 9,548,578 B2
(45) Date of Patent: Jan. 17, 2017

(54) SOCKET APPARATUS

(71) Applicant: Ran Azoulay, Dimona (IL)

(72) Inventor: Ran Azoulay, Dimona (IL)

( * ) Notice: Subject to any disclaimer, the term of this patent is extended or adjusted under 35 U.S.C. 154(b) by 0 days.

(21) Appl. No.: 15/201,633

(22) Filed: Jul. 5, 2016

(65) Prior Publication Data

US 2016/0315434 A1 Oct. 27, 2016

Related U.S. Application Data

(63) Continuation-in-part of application No. 14/628,310, filed on Feb. 23, 2015.

(30) Foreign Application Priority Data

Feb. 27, 2014 (IL) ..... 231214

(51) Int. Cl.

| | |
|---|---|
| ***H01R 25/00*** | (2006.01) |
| ***H01R 27/02*** | (2006.01) |
| ***H01R 13/443*** | (2006.01) |
| ***H01R 13/70*** | (2006.01) |
| ***H01R 13/717*** | (2006.01) |
| ***H01R 24/76*** | (2011.01) |
| *H01R 105/00* | (2006.01) |
| *H01R 107/00* | (2006.01) |

(52) U.S. Cl.

CPC ..... *H01R 27/02* (2013.01); *H01R 13/443* (2013.01); *H01R 13/70* (2013.01); *H01R 13/717* (2013.01); *H01R 24/76* (2013.01); *H01R 2105/00* (2013.01); *H01R 2107/00* (2013.01)

(58) Field of Classification Search

CPC ..... H01R 31/00
USPC ..... 439/225
See application file for complete search history.

(56) References Cited

U.S. PATENT DOCUMENTS

| | | | | |
|---|---|---|---|---|
| 7,179,130 B2 * | 2/2007 | Judge | H01R 27/02 | 439/188 |
| 2002/0118561 A1 * | 8/2002 | Katayama | H01R 31/065 | 363/146 |

* cited by examiner

*Primary Examiner* — Neil Abrams
(74) *Attorney, Agent, or Firm* — Daniel J. Swirksy; AlphaPatent Associates Ltd.

(57) ABSTRACT

A socket apparatus, including a plate for being held by sockets of a wall outlet in contact with a front surface of the wall outlet, the plate shaped complementary to the front surface of the wall outlet and having holes shaped and located corresponding to the sockets of the wall outlet; metal apertures, each extending from one of the holes of the plate, the metal apertures for receiving electric supply from the sockets of the wall outlet, and for inserting prongs of a plug of an electric appliance thereinto, an electric gadget, for providing an electric function, and an electric circuit, for receiving electric supply from the metal apertures, and for converting the electric supply to the electric function. The wall socket further includes an extension pin, for allowing attaching thereof to at least one of the prongs of the plug of the electric appliance, for extending thereof.

9 Claims, 11 Drawing Sheets

SOCKET APPARATUS

CROSS-REFERENCE TO RELATED APPLICATIONS

This application is a Continuation-in-Part of U.S. patent application Ser. No. 14/628,310, filed Feb. 23, 2015, which claims the benefit of priority from Israel Patent Application No. 231214 filed Feb. 27, 2014, the disclosures of which are incorporated herein by reference.

TECHNICAL FIELD

The invention relates to the field of electric plugs and sockets. More particularly, the invention relates to removable sockets.

BACKGROUND

Wall sockets supply high alternating voltage, such as 220 VAC. Wall sockets are designed, regarding esthetical, physical and safety considerations, substantially not to protrude out of the wall.

Wall sockets adding other functions, such as USB outlets are also disclosed.

However, replacement of the standard wall socket with a wall socket including the USB outlet is not user operable.

Removable sockets having prongs and holes are typically used for providing multiple outputs. These too are disclosed, including USB outlets.

However, the removable sockets are disadvantaged of protruding out of the wall and out of the wall outlet.

All the methods described above have not yet provided satisfactory solutions to the long felt need of user operably adding a USB outlet to a wall socket without protrusion from the wall.

SUMMARY

In one aspect of the invention the invention provides an apparatus for user operably adding a USB outlet to a wall socket without protrusion from the wall.

In another aspect of the invention the invention provides a solution to the above-mentioned and other problems of the prior art.

Other aspects of the invention will become apparent as the description proceeds.

In one aspect of the invention a socket apparatus is provided, comprising:

a plate for being held by sockets of a wall outlet in contact with a front surface of the wall outlet, the plate shaped complementary to the front surface of the wall outlet and comprising holes shaped and located corresponding to the sockets of the wall outlet;

metal apertures, each extending from one of the holes of the plate, the metal apertures for receiving electric supply from the sockets of the wall outlet, and for inserting prongs of a plug of an electric appliance thereinto;

an electric gadget, for providing an electric function; and an electric circuit, for receiving electric supply from the metal apertures, and for converting the electric supply to the electric function, thereby the socket apparatus, being removeable from the wall outlet, adds the electric function thereto, while substantially not protruding therefrom.

Each of the metal apertures, extending from one of the holes of the plate, may comprise a hollowed elongated metal plug, for being inserted into the corresponding socket of the wall outlet for receiving the electric supply therefrom.

Each of the metal apertures extending from one of the holes of the plate may comprise a springy ring, for embracing a prong, for electrically contacting thereto, for receiving the electric supply therefrom.

The socket apparatus may further comprise:

a dummy plug comprising prongs for being inserted into the sockets of the wall outlet for receiving the electric supply from the sockets of the wall outlet, and for transferring the electric supply to the metal apertures.

The electric gadget may comprise a Universal Serial Bus (USB) outlet.

The electric gadget may comprise a low voltage outlet.

The electric gadget may comprise a light bulb and a switch for turning the bulb on and off.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF THE DRAWINGS

Embodiments, features, and aspects and of the invention are described herein in conjunction with the following drawings.

It should be understood that the drawings are not necessarily drawn to scale.

DETAILED DESCRIPTION

The invention will be understood from the following detailed description of embodiments thereof, which are meant to be descriptive and not limiting. For the sake of brevity, some well-known features, methods, systems, procedures, components, circuits, and so on, are not described in detail.

Figure 1:
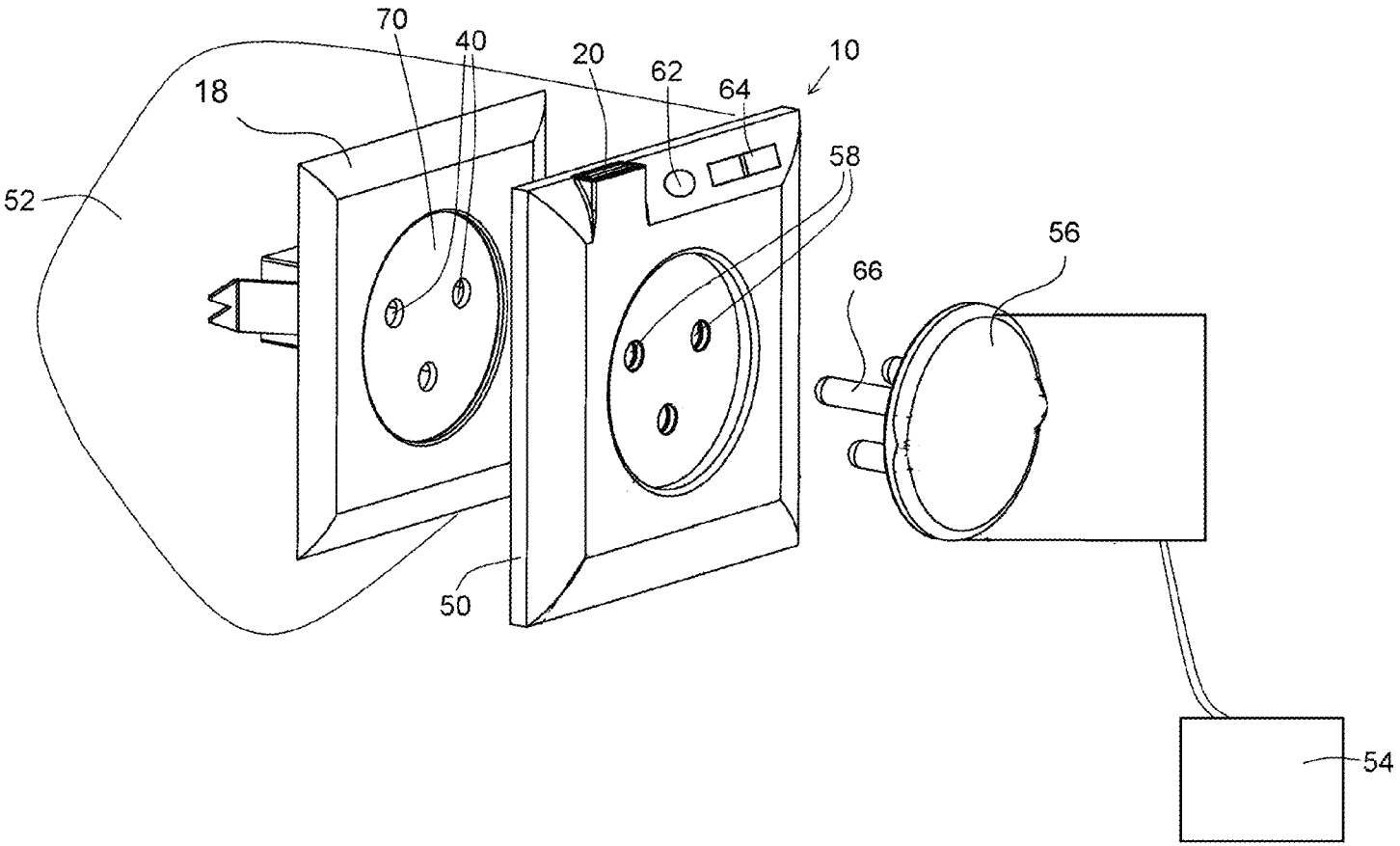
FIG. 1 is a front view of a socket according to one embodiment of the invention, including a wall outlet and an appliance's plug for being connected thereto.

FIG. 1 is a front view of a socket according to one embodiment of the invention, including a wall outlet and an appliance's plug for being connected thereto.

A socket apparatus 10, according to the invention, constitutes a thin plate 50, shaped like wall outlet 18, for being connected to a wall outlet 18, by covering wall outlet 18. The connection of socket apparatus 10 to wall outlet 18 is user operable, i.e., carried out by pressing it only, without any tool, towards wall outlet 18. Plate 50 includes holes 58 fitted to sockets 40 of wall outlet 18, for inserting prongs 66 of a plug 56 of an appliance 54.

Upon connecting socket apparatus 10 to wall outlet 18, socket apparatus 10 provides the electric supply 72 (not illustrated), supplied by wall outlet 18, to plug 56 of appliance 54.

The rear surface 68 (not shown) of plate 50 is substantially shaped complementary to the front surface 70 of wall outlet 18. Since plate 50 is thin and is shaped like wall outlet 18, socket apparatus 10, upon being connected to wall outlet 18, is advantaged in substantially not protruding from the wall 52. Thus, according to one aspect of the invention, socket apparatus 10 may be used for changing or renewing the appearance of wall outlet 18.

In addition, socket apparatus 10 includes at least one electric gadget 20, receiving the electric supply 72 (not illustrated) therefor, from wall outlet 18.

According to a main embodiment, electric gadget 20 may constitute a Universal Serial Bus (USB) outlet, or any other output supply. According to another embodiment, electric gadget 20 may constitute a light bulb 62 and a switch 64, for turning bulb 62 on and off.

Figure 2:
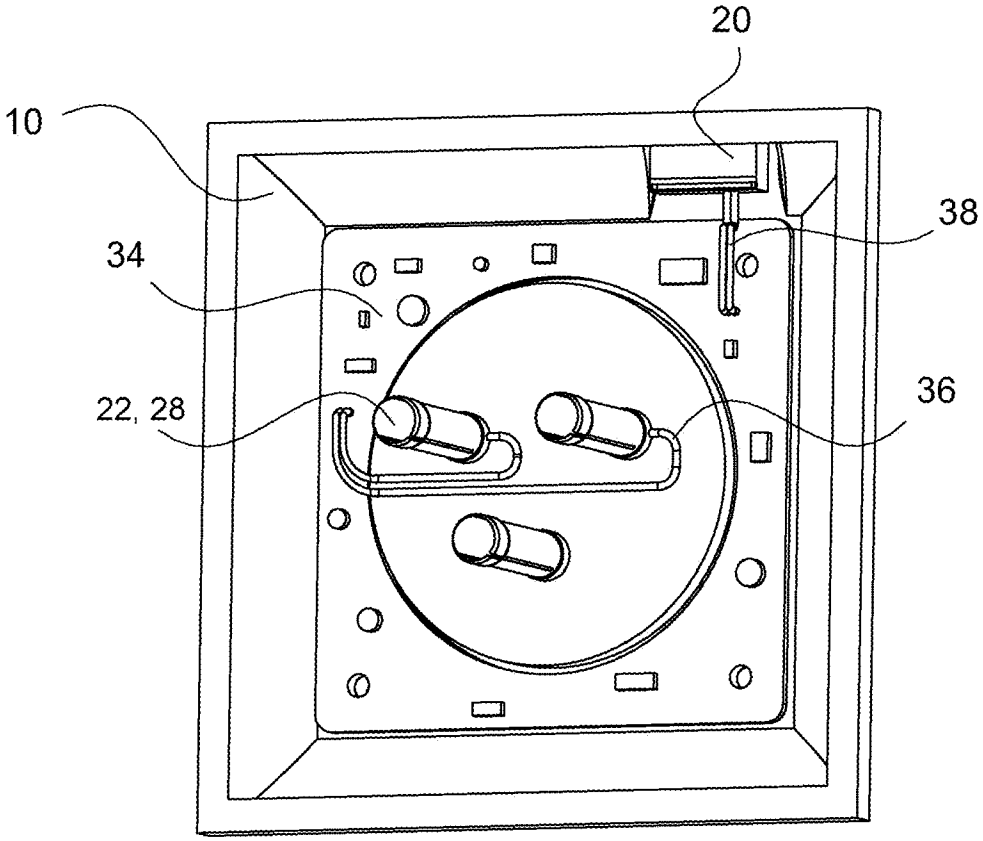
FIG. 2 is a rear view of the socket of FIG. 1, according to one embodiment.

FIG. 2 is a rear view of the socket of FIG. 1, according to one embodiment.

A metal aperture 28 extends from each of holes 58 (shown in FIG. 1) of plate 50. Metal apertures 28 provides the high voltage of wall outlet 18 to an electric circuit 34, for producing the appropriate voltage need by electric gadget 20.

According to one embodiment, each metal aperture 28 constitutes a hollowed elongated metal plug 22, for being inserted into the corresponding socket 40 of wall outlet 18, thus physically holding metal plug 22 and plate 50; and for inserting the corresponding prong 66 of plug 56 of appliance 54 (shown in FIG. 1) thereinto. Hollowed elongated metal plugs 22 are sufficiently springy for contacting sockets 40 (shown in FIG. 1) of wall outlet 18 and prongs 66 of appliance 54. Thus, hollowed metal plugs 22 transfer the electric supply 72 (not illustrated) from sockets 40 (shown in FIG. 1) of wall outlet 18 to prongs 66 of appliance 54.

Input wires 36 transfer the high electric voltage from hollowed metal plugs 22 to an electric circuit 34, which may surround hollowed metal plugs 22.

Electric circuit 34 may convert the high voltage to low voltage, such as to that required by the USB outlet. Output wires 38 may transfer the voltage produced electric circuit 34 therefrom to electric gadget 20.

Gadget 20 consumes relatively low power, thus the walls of hollowed plugs 22 may be relatively thin for transferring the high electric voltage from hollowed metal plugs 22 to electric circuit 34.

Figure 3:
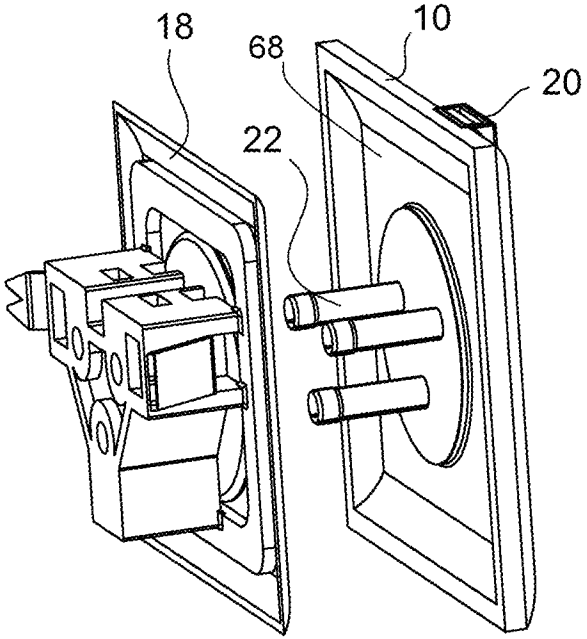
FIG. 3 is a side view of the socket of FIG. 2, including the wall outlet depicted in FIG. 1.

FIG. 3 is a side view of the socket of FIG. 2, including the wall outlet depicted in FIG. 1.

The rear surface 68 of plate 50 is shaped complementary to the front surface 70 (not shown) of wall outlet 18.

Figure 4:
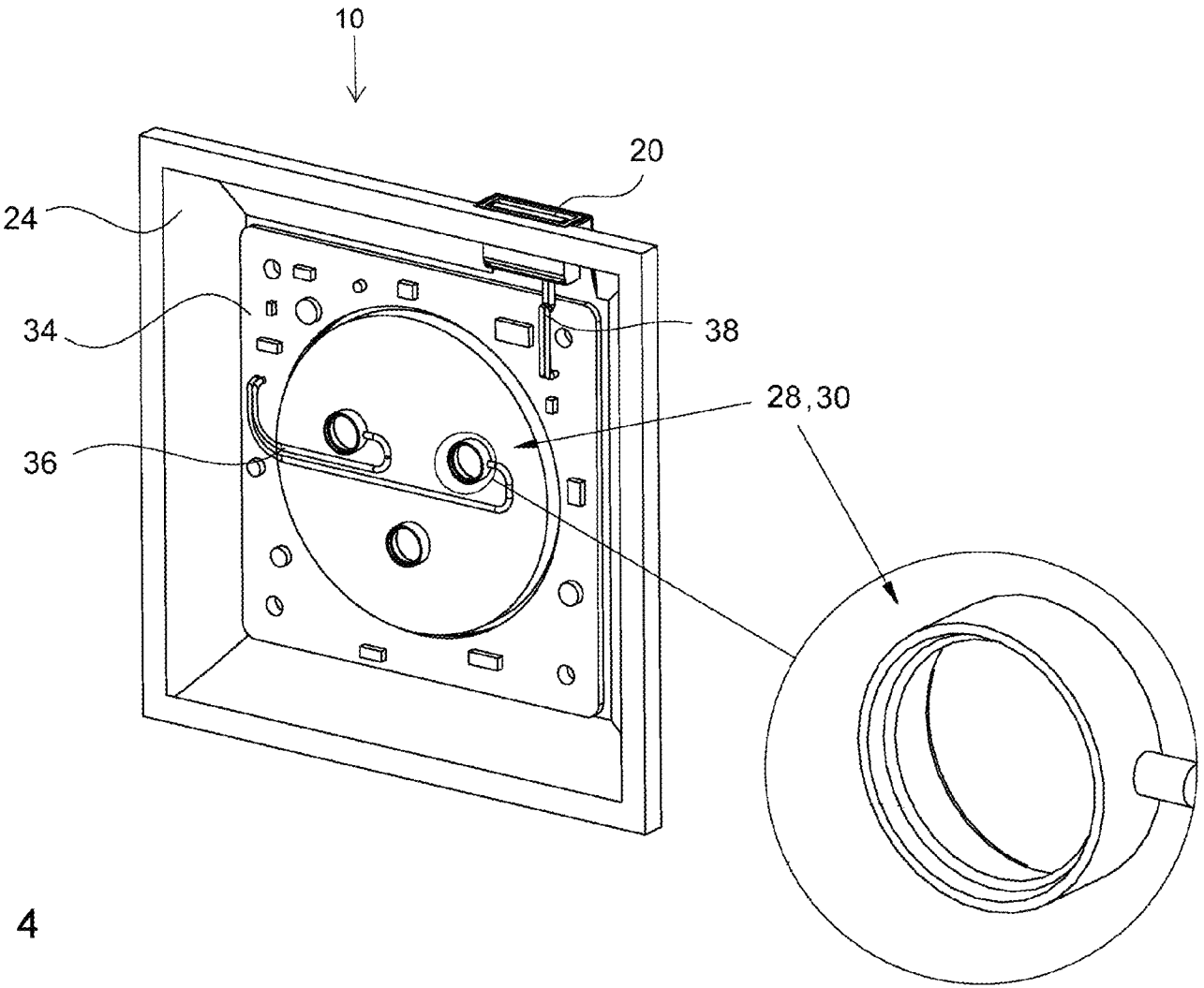
FIG. 4 is a rear view of the socket of FIG. 1, according to another embodiment.

FIG. 4 is a rear view of the socket of FIG. 1, according to another embodiment.

According to another embodiment, each metal aperture 28 constitutes a springy ring 30, fitting to prongs 66 of appliance 54 for embracing thereof and thus electrically contacting thereto. Springy ring 30 are not elongated, thus do not transfer the electric supply 72 (not illustrated) directly from sockets 40 (shown in FIG. 1) of wall outlet 18 to prongs 66 of appliance 54.

Springy rings 30 are short, thus may not be inserted into sockets 40 of wall outlet 18. Springy rings 30 are designed for inserting prongs 66 of plug 56 of appliance 54 (shown in FIG. 1) thereinto, such that prongs 66 transfer the high electric voltage to springy rings 30.

Input wires 36 transfer the high electric voltage from springy rings 30 to electric circuit 34, which may surround springy rings 30.

Electric circuit 34 may convert the high voltage to low voltage, such as to that required by the USB outlet. Output wires 38 may transfer the voltage produced electric circuit 34 therefrom to electric gadget 20.

Springy rings 30 receive the electric voltage from prongs 66. Once prongs 66 of appliance 54 are removed from sockets 40 of wall outlet 18, springy rings 30 do not receive the electric supply 72 (not illustrated), and thus input wires 36 do not supply the electric supply 72 (not illustrated) to electric circuit 34.

Figure 5:
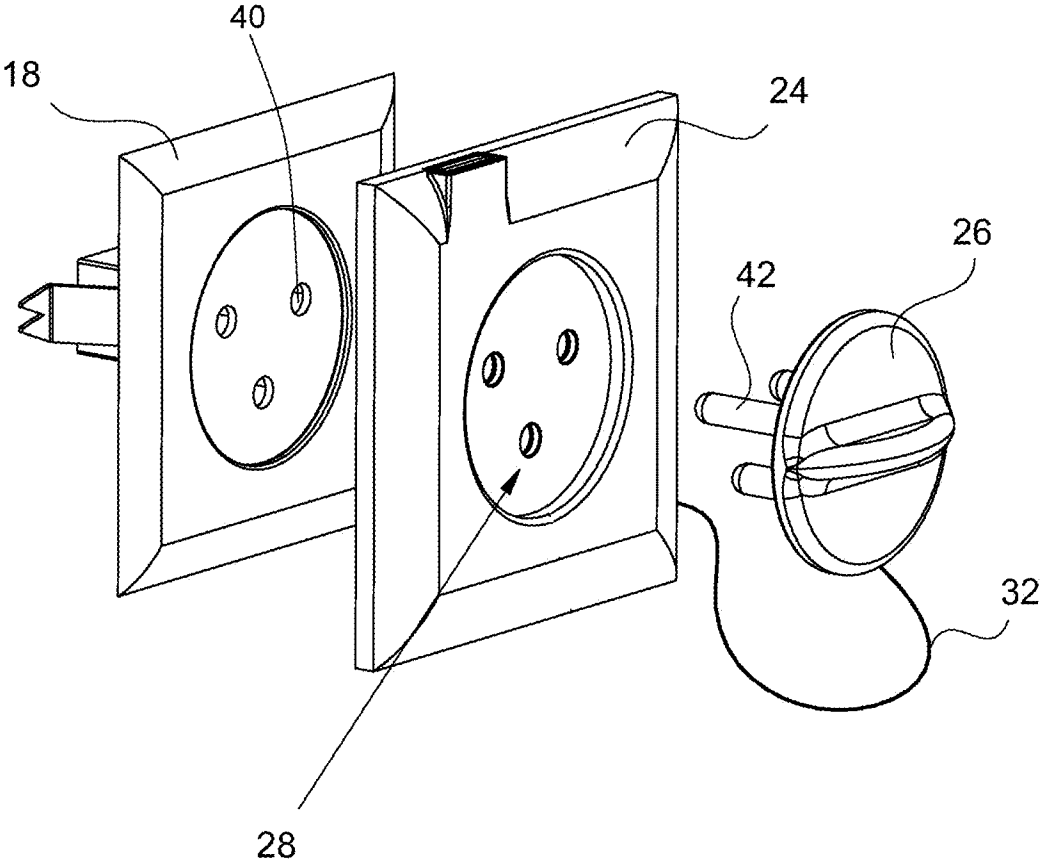
FIG. 5 is a front view of the socket according to the embodiment of FIG. 4, including the wall outlet and a dummy plug for being connected thereto, according to one embodiment of the invention.

FIG. 5 is a front view of the socket according to the embodiment of FIG. 4, including the wall outlet and a dummy plug for being connected thereto, according to one embodiment of the invention.

In order that springy rings 30 receive the electric supply 72 even once prongs 66 of appliance 54 are removed from sockets 40 of wall outlet 18, a dummy plug 26 including prongs 42 may be inserted into sockets 40 of wall outlet 18, for replacing prongs 66 of appliance 54. According to this embodiment, prongs 42 being inserted into sockets 40 of wall outlet 18 hold plate 50 in contact with wall outlet 18. Dummy plug 26 preferably includes a string 32 for being hung thereon, for not being lost while being unplugged.

Figure 6:
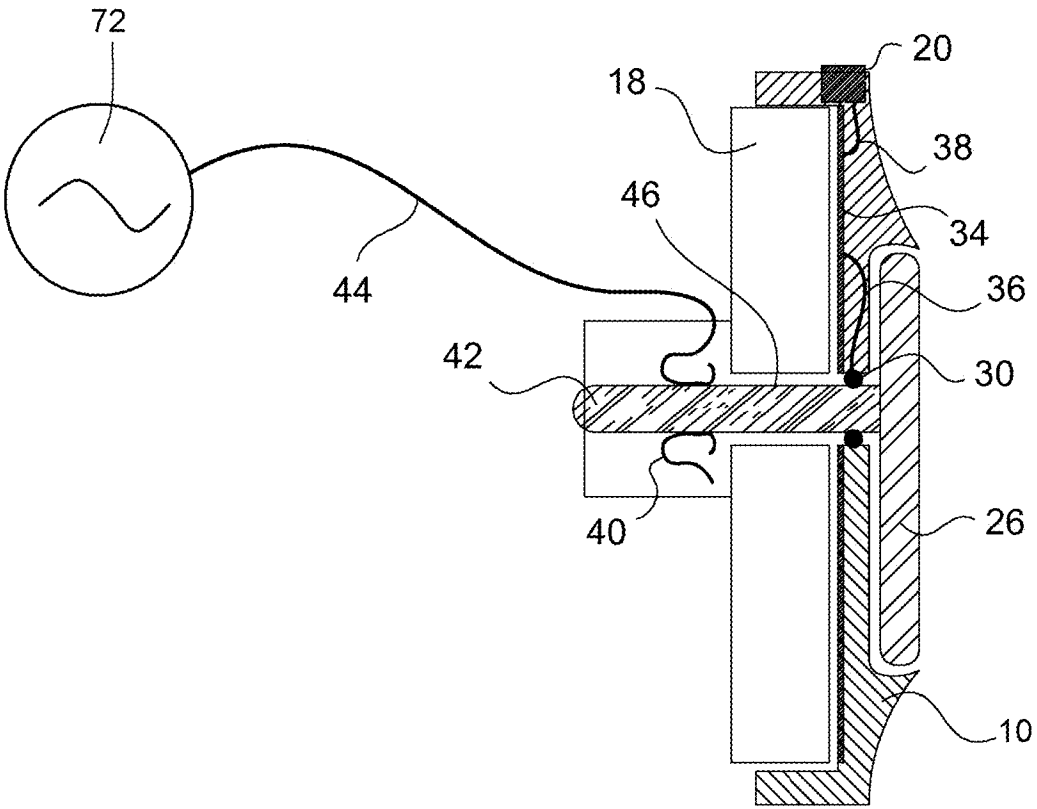
FIG. 6 is a side sectional view of the socket of FIG. 5, including the wall outlet and the dummy plug for being connected thereto, according to one embodiment of the invention.

FIG. 6 is a side sectional view of the socket of FIG. 5, including the wall outlet and the dummy plug for being connected thereto, according to one embodiment of the invention.

The electric supply 72 is supplied by an electric wire 44 to socket 40. Prong 42 of dummy plug 26 transfers the electric supply to springy ring 30 of metal aperture 28 of socket apparatus 10 of FIG. 5. Input wire 36 transfers the electric supply to electric circuit 34. Output wire 38 transfers the converted voltage to gadget 20.

Figure 7:
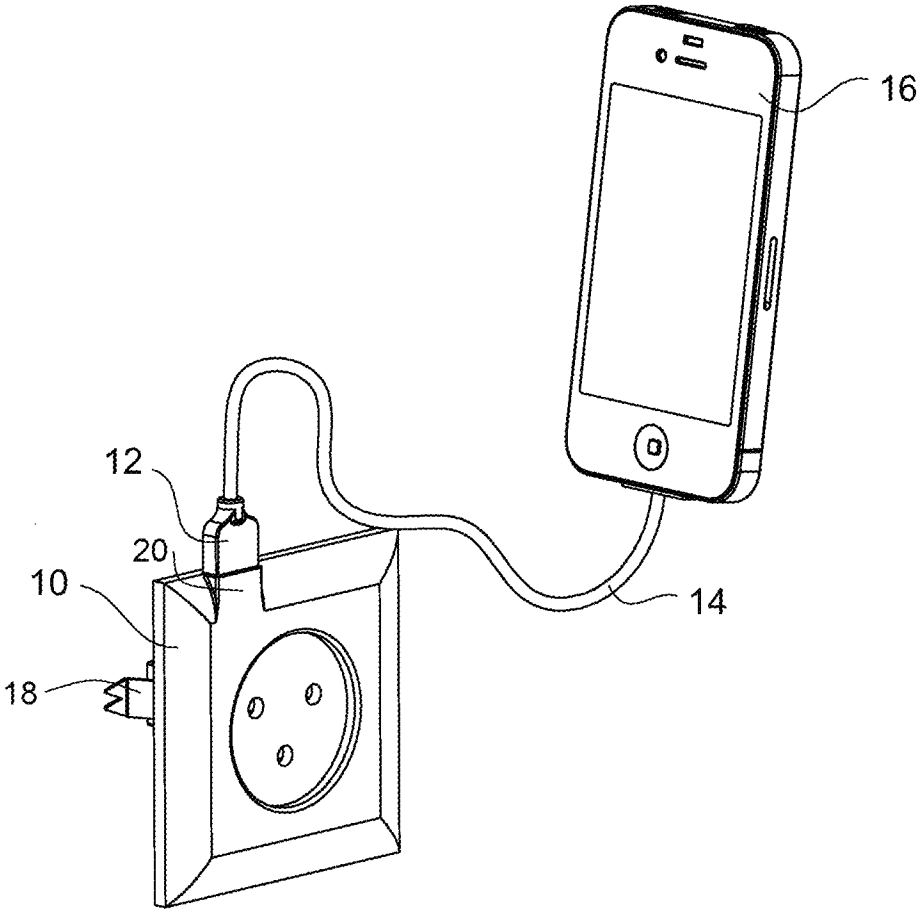
FIG. 7 shows the usage of the socket apparatus of FIG. 1.

FIG. 7 shows the usage of the socket apparatus of FIG. 1.

A mobile phone 16 is depicted charged through an adaptor 14 ending with a USB plug 12 plugged into USB outlet 20 of socket apparatus 10 connected to wall outlet 18.

Figure 8:
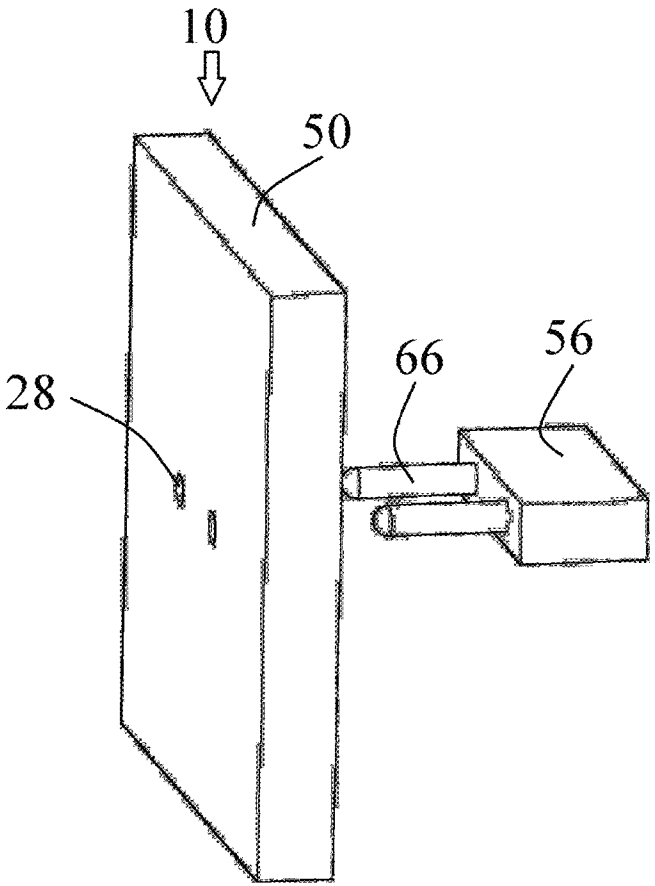
FIG. 8 depicts the position prior to insertion of inserting the electric appliance plug into the socket apparatus of FIG. 4.

FIG. 8 depicts the position prior to insertion of inserting the electric appliance plug into the socket apparatus of FIG. 4.

Figure 9:
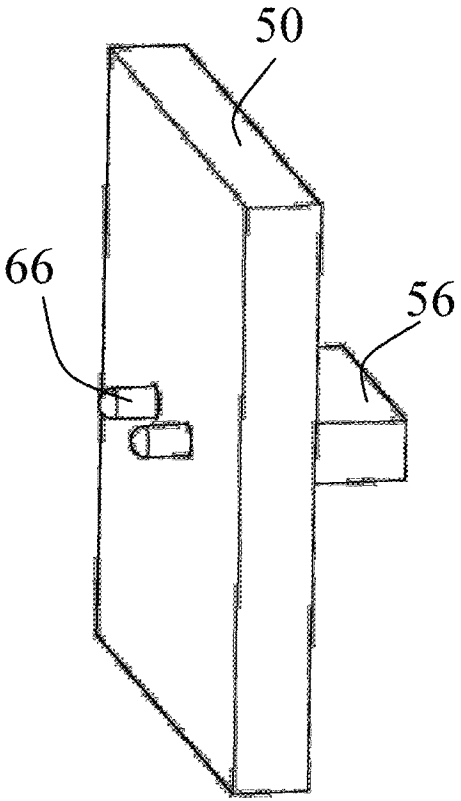
FIG. 9 depicts the position upon the insertion of inserting the electric appliance plug into the socket apparatus of FIG. 4.

FIG. 9 depicts the position upon the insertion of inserting the electric appliance plug into the socket apparatus of FIG. 4.

The term "effective length of prong" refers herein to the length of the prong of a plug, being insertable into a socket of a wall outlet.

The thickness of plate 50 of socket apparatus 10 is indeed not negligible in relation to prongs 66 of plug 56 of the electric appliance, and thus socket apparatus 10 as described above, is disadvantaged in that it shortens the effective length of prongs 66.

Figure 10:
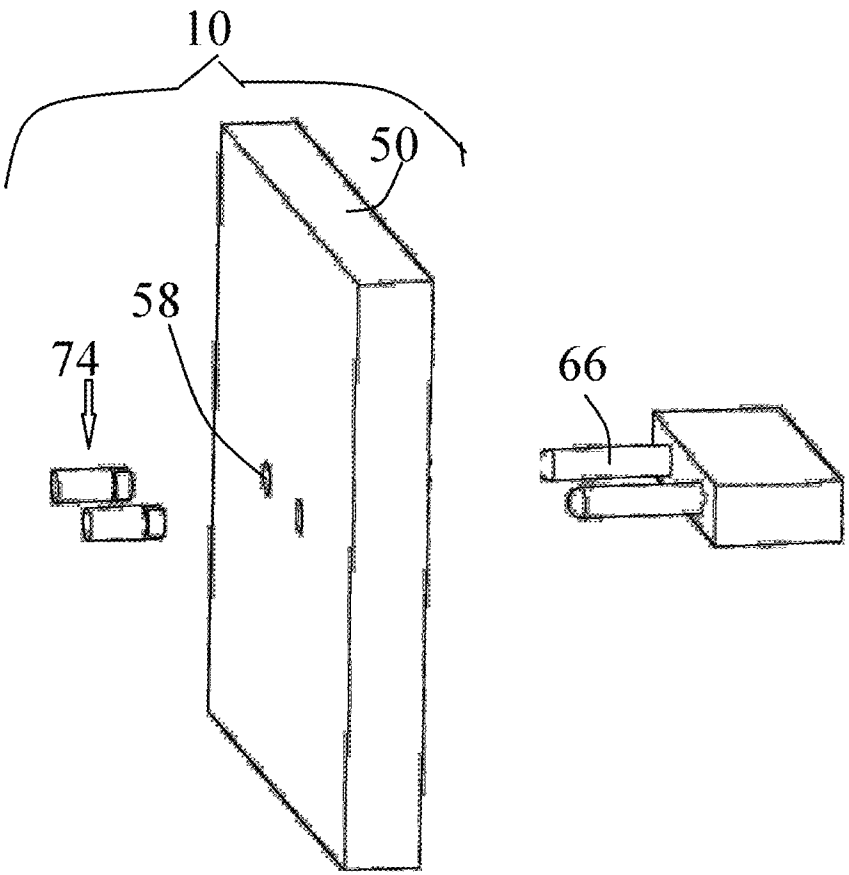
FIG. 10 is a perspective view of a socket apparatus according to another embodiment, for solving the problem shown in FIG. 9.

FIG. 10 is a perspective view of a socket apparatus according to another embodiment, for solving the problem shown in FIG. 9.

According to the embodiment of FIG. 10, socket apparatus 10 further includes pin extensions 74, each for extending one of prongs 66.

Figure 11:
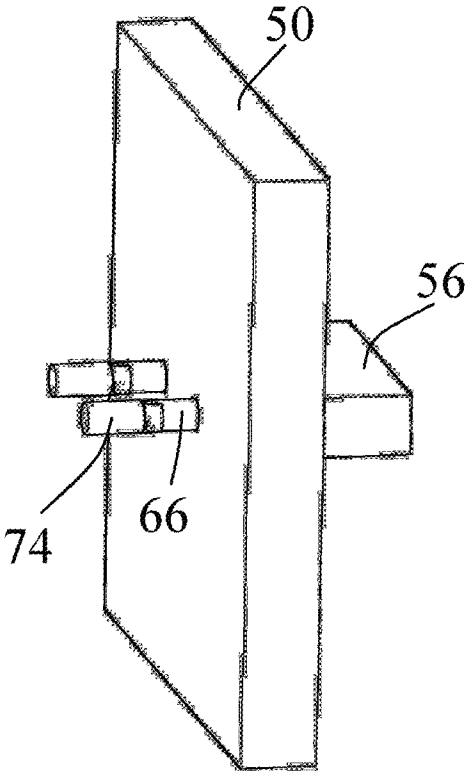
FIG. 11 depicts the socket apparatus of FIG. 10 upon inserting the plug of FIG. 10.

FIG. 11 depicts the socket apparatus of FIG. 10 upon inserting the plug of FIG. 10.

Pin extension 74 connects prong 66, thereby enlarging the effective length of the prong, approximately to the original length of FIG. 10.

Figure 12:
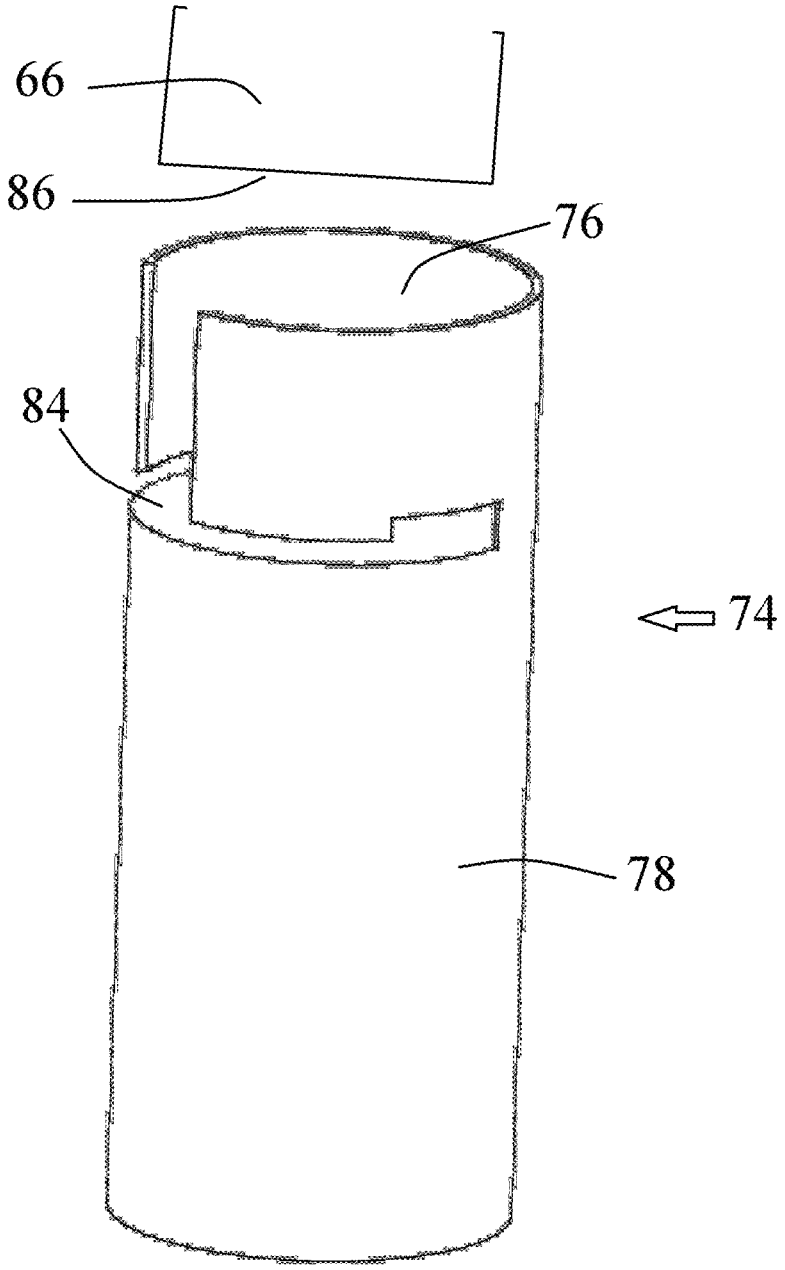
FIG. 12 is a perspective enlarged view of the pin extension 74 of FIG. 11.

FIG. 12 is a perspective enlarged view of the pin extension 74 of FIG. 11.

Pin extension 74 includes a springy ringed portion 76, for embracing prong 66; and a non-hollowed portion 78, for functioning as a plug, i.e., for extending prong 66.

The main electrical connection is by surface 84 of non-hollowed portion 78 of pin extension 74, pressing end surface 86 of prong 66.

Figure 13:
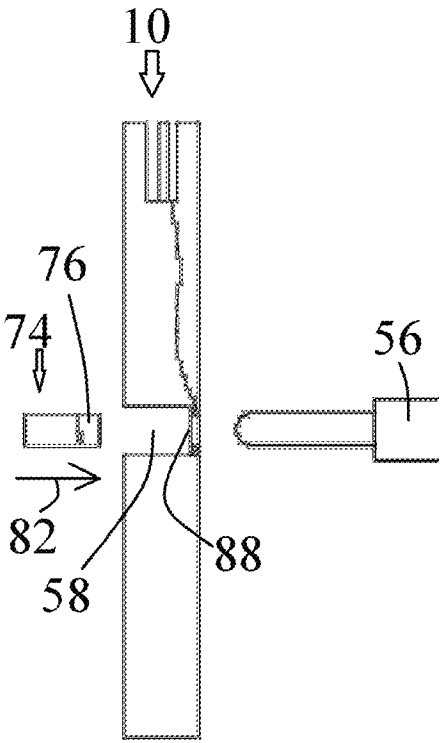
FIG. 13 is a side schematic view of FIG. 10.

FIG. 13 is a side schematic view of FIG. 10.

According to one approach, the user may connect springy ring 76 of pin extension 74 to prong 56 by threading prong 56 through hole 58 of socket apparatus 10, and then by pressing pin extension 74 towards prong 56, as shown by the arrows.

Then, the user may press plug 56 onto the wall outlet.

Figure 14:
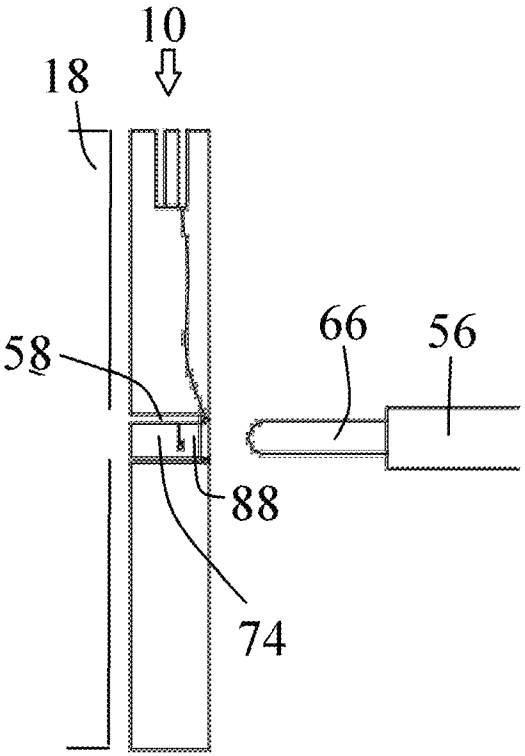
FIG. 14 depicts another approach for using the socket apparatus of FIG. 10.

FIG. 14 depicts another approach for using the socket apparatus of FIG. 10.

According to one embodiment, hole 58 of socket apparatus 10 may be capable of housing pin extension 74, in a steady manner.

Thus, from this position, while socket apparatus 10 is already attached to the wall outlet, the user presses plug 56 for inserting prong 66 into hole 58 of socket apparatus 10.

Figure 15:
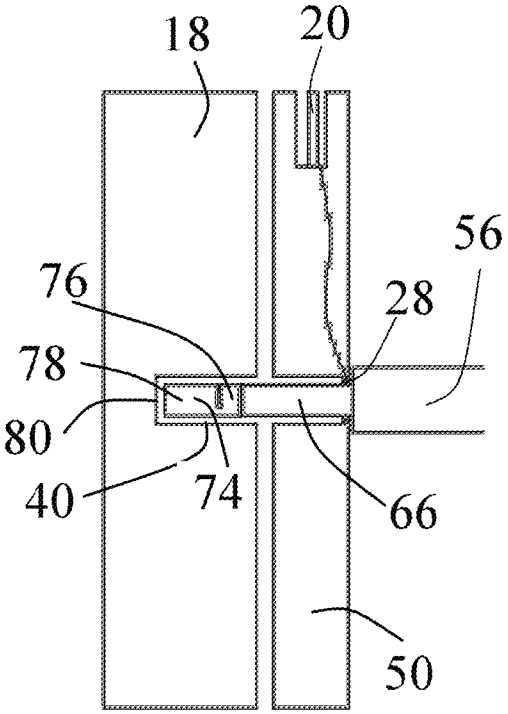
FIG. 15 depicts the plug inserted into the wall outlet, through the socket apparatus of FIG. 10.

FIG. 15 depicts the plug inserted into the wall outlet, through the socket apparatus of FIG. 10.

Upon pressing plug 56 for inserting prong 66 into hole 58 of socket apparatus 10, prong 66 presses pin extension 78 onto the end 80 of socket 40 of wall outlet 18. Thus end 80 presses ring 76 of pin extension 78 towards prong 66, similar to arrow 82 of FIG. 13.

Thus, socket 40 supplies current both to a portion of prong 66 and as well to pin extension 74. The electric current flows therefrom to metal aperture 28 of socket apparatus 10, and therefrom to electric gadget 20.

Spring ring 76 embraces prong 66 stronger than the embracing of socket 40 of wall outlet 18. Thus, pulling of plug 56 maintains pin extension 74 attached to prong 66, and removes pin extension 74 from socket 40 of wall outlet 18.

Referring again to FIGS. 13 and 14, hole 58 of plate 50 of socket apparatus may include a protrusion 88 for not allowing pin extension 74 to cross the hole.

Thus, the pulling of plug 56 out from the position of FIG. 15, in case of maintaining plate 50 of socket apparatus 10 attached to wall outlet 28, inserts pin extension 74 into hole 58 of plate 50, for making hole 58 house pin extension 74.

In the figures and/or description herein, the following reference numerals (Reference Signs List) have been mentioned:

numeral 10 denotes a socket apparatus according to one embodiment of the invention;

numeral 12 denotes a USB plug;

numeral 14 denotes an adaptor;

numeral 16 denotes a mobile phone;

numeral 18 denotes a wall outlet;

numeral 20 denotes a USB outlet, or any other electric gadget operating on low voltage;

numeral 22 denotes a hollowed metal plug, the plug conducting electric flow;

numeral 26 denotes a dummy plug, i.e., for electrically connecting the metal apertures of the socket apparatus to the sockets of the wall outlet, and for physically connecting the socket apparatus to the wall outlet;

numeral 28 denotes a metal aperture of the socket apparatus, for transferring the electric supply to the electric circuit;

numeral 30 denotes a springy ring, for providing physical contact, for providing electrical contact;

numeral 32 denotes a string;

numeral 34 denotes an electric circuit;

numerals 36 and 38 denote electric wires;

numeral 40 denotes an existing socket of the existing wall outlet; the wall outlet includes two or three sockets, the sockets being springy;

numeral 42 denotes a prong of the dummy plug;

numeral 44 denotes an electric wire;

numeral 50 denotes a shaped plate;

numeral 52 denotes the wall of the room;

numeral 54 denotes an electric appliance;

numeral 56 denotes a plug of the electric appliance;

numeral 58 denotes a hole in the shaped plate;

numeral 62 denotes a light bulb;

numeral 64 denotes a switch;

numeral 66 denotes a prong of a plug of the electric appliance;

numeral 68 denotes the rear surface of the shaped plate;

numeral 70 denotes the front surface of the wall outlet; and numeral 72 denotes the electric supply, typically supplied by the electric network;

numeral 74 denotes the pin extension;

numeral 76 denotes the springy ringed portion of the pin extension;

numeral 78 denotes the non-hollowed portion of the pin extension;

numeral 80 denotes the end of the socket;

numeral 82 denotes an arrow;

numeral 84 denotes the surface of the non-hollowed portion of the pin extension;

numeral 86 denotes the surface of the prong; and numeral 88 denotes a protrusion at the hole of the plate of the wall socket.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A socket apparatus comprising:

a plate for being held by sockets of a wall outlet in contact with a front surface of said wall outlet, said plate shaped complementary to the front surface of said wall outlet and comprising holes shaped and located corresponding to the sockets of the wall outlet;

metal apertures, each extending from one of said holes of said plate, said metal apertures for receiving electric supply from said sockets of said wall outlet, and for inserting prongs of a plug of an electric appliance thereinto;

an electric gadget, for providing an electric function; and an electric circuit, for receiving electric supply from said metal apertures, and for converting said electric supply to said electric function; and at least one extension pin, for allowing attaching thereof to at least one of the prongs of the plug of the electric appliance, for extending thereof, thereby improving electrical conductance from the wall outlet to the electric appliance, thereby said socket apparatus, being removable from the wall outlet, adds said electric function thereto, while not shortening effective length of the prongs.

2. A socket apparatus according to claim 1, wherein each of said metal apertures, extending from one of said holes of said plate, comprises a hollowed elongated metal plug, for being inserted into the corresponding socket of said wall outlet for receiving the electric supply therefrom.

3. A socket apparatus according to claim 1, wherein each of said metal apertures extending from one of said holes of said plate comprises a springy ring, for embracing a prong, for electrically contacting thereto, for receiving the electric supply therefrom.

4. A socket apparatus according to claim 1, further comprising:

a dummy plug comprising prongs for being inserted into said sockets of said wall outlet for receiving the electric supply from said sockets of said wall outlet, and for transferring the electric supply to said metal apertures.

5. A socket apparatus according to claim 1, wherein said electric gadget comprises a Universal Serial Bus (USB) outlet.

6. A socket apparatus according to claim 1, wherein said electric gadget comprises a low voltage outlet.

7. A socket apparatus according to claim 1, wherein said electric gadget comprises a light bulb and a switch for turning said bulb on and off.

8. A socket apparatus according to claim 1, wherein said extension pin comprises a springy ring, for embracing the prong, thereby pulling of the plug maintains said pin extension attached to the prong, and removes the pin extension from the socket of the wall outlet.

9. A socket apparatus according to claim 1, wherein said hole of said plate of said wall socket comprises a protrusion, for not allowing said pin extension to cross the hole, thus pulling of the plug houses said pin extension within the hole.

* * * * *